United States Patent [19]

Acklin et al.

[11] Patent Number: 4,645,094

[45] Date of Patent: Feb. 24, 1987

[54] PHOTO-ELECTRIC CONTROLLED DISPENSER

[75] Inventors: John R. Acklin, St. Louis; Lee W. Bush, Chesterfield; Joseph J. Danna, Florissant, all of Mo.; John L. Devitt, Denver, Colo.; George A. Rauh, Manchester, Mo.

[73] Assignee: Calgon Corporation, Pittsburgh, Pa.

[21] Appl. No.: 825,025

[22] Filed: Jan. 31, 1986

Related U.S. Application Data

[63] Continuation of Ser. No. 488,867, Apr. 26, 1983, abandoned.

[51] Int. Cl.[4] ..... B65D 35/28; B67D 5/06

[52] U.S. Cl. ..... 222/52; 222/641; 222/103; 222/105; 222/504; 250/221

[58] Field of Search ..... 222/41, 52, 95, 96, 222/103, 105, 504, 494, 214, 638, 639, 641, 642, 644; 250/214 AL, 210, 221, 577, 206; 221/279; 209/526; 194/904; 141/94, 360

[56] References Cited

U.S. PATENT DOCUMENTS

| | | | |
|---|---|---|---|
| 103,640 | 5/1870 | Merritt | 222/103 X |
| 1,396,772 | 11/1921 | Moritz et al. | 221/279 |
| 2,387,359 | 10/1945 | Scarry | 222/52 |
| 2,540,842 | 2/1951 | Stanley et al. | 222/494 X |
| 2,903,165 | 9/1959 | Hanson et al. | 222/504 X |
| 3,017,883 | 1/1962 | Dickinson, Jr. | 222/41 X |
| 3,033,248 | 5/1962 | Ritchie | 222/52 X |
| 3,035,737 | 5/1962 | Speas | 222/88 X |
| 3,273,752 | 9/1966 | Horeczky | 222/52 |
| 3,327,901 | 6/1967 | Yerkovich | 222/52 |
| 3,445,039 | 5/1969 | Brodsky et al. | 222/504 X |
| 4,157,771 | 6/1979 | Smith | 222/103 |
| 4,165,277 | 8/1979 | Frewin | 209/526 X |
| 4,184,580 | 1/1980 | Ellis, Jr. | 194/904 X |
| 4,202,387 | 5/1980 | Upton | 222/54 X |
| 4,220,259 | 9/1980 | Lagneaux | 222/103 X |
| 4,228,926 | 10/1980 | Gordon | 222/103 |
| 4,373,647 | 2/1983 | Hollingsworth | 222/105 X |
| 4,391,373 | 7/1983 | Wiggins | 209/526 |
| 4,520,948 | 6/1985 | Hampel et al. | 222/103 |

*Primary Examiner*—Charles A. Marmor
*Assistant Examiner*—Kevin P. Shaver
*Attorney, Agent, or Firm*—W. C. Mitchell; M. C. Sudol, Jr.; R. B. Olson

[57] ABSTRACT

A fluid dispenser for dispensing liquid detergents, soaps and germicides. A pressure plate imparts a squeezing force to a flexible reservoir containing the liquid material to force the material therefrom. A battery operated photoelectric device is positioned adjacent the dispensing valve which is opened for a timed period upon locating an object such as a hand, near the photoelectric device. Also, a device is provided to control the power to the photoelectric device upon sensing the condition of the ambient room lighting.

10 Claims, 6 Drawing Figures

PHOTO-ELECTRIC CONTROLLED DISPENSER

This is a continuation, of application Ser. No. 488,867 now abandoned, filed Apr. 26, 1983.

BACKGROUND OF THE INVENTION

This invention relates to automatic dispensers, in particular for dispensing liquid detergents, soaps and germicides. A need has long existed for a dispenser that would release a measured quantity of soap or other material without the need for the user to depress a button, move a handle or the like. The handling of such actuators of conventional dispensers by a number of users spreads disease causing micro-organisms and creates an unsightly appearance around the dispenser actuator. Thus, a dispenser that would release a predetermined quantity of liquid soap or the like in response to the presence of a hand or other receiving object placed under the dispenser outlet would eliminate the aforementioned disadvantages of conventional dispensers.

Therefore it is an object of this invention to release soap, detergent, or other liquid or semi-solid materials (hereinafter termed fluid) in response to the mere placement of a hand or other receiving object within the proximity of the dispenser outlet.

It is a further object of this invention that a predetermined quantity of fluid (hereinafter termed a portion) be released from the dispenser upon each instance of use.

Further, it is an object of this invention that the dispenser be adapted to the use of a disposable fluid container which can be placed within the dispenser, and that such a disposable container be integrally connected to disposable valve means and outlet means. In this manner, the entire wetted pathway from the container through the outlet means may be discarded after the emptying of the container, thereby minimizing the opportunities for a build-up of micro-organisms.

It is a further object of this invention that the dispenser contain a proximity detector means of an electrical nature, and that said proximity detector means consumes a minimum of electric power, thereby allowing the use of disposable or rechargeable batteries.

DESCRIPTION OF THE DRAWINGS

FIG. 5 is a perspective view showing the container pressure plate raised.

SUMMARY OF THE INVENTION

The instant invention is directed to a fluid dispenser comprising:

(a) a flexible container for a fluid, integrally connected to valve means and outlet means:

(b) means for imparting a squeezing force to said flexible container;

(c) and proximity detector means connected to means for opening and closing said valve means.

DETAILED DESCRIPTION OF THE INVENTION

This invention is particularly directed to a fluid dispenser which contains an electric power source, an electronic proximity detector, a means for holding and supporting a flexible, disposable bag container, an actuator which opens and closes a disposable valve which is part of the container assembly, and a pressurizing means which applies a force to the top of the bag, moving fluid from the bag through the valve when the valve is open.

In a preferred embodiment of this invention, the power source for the dispenser is a dry-cell battery, allowing location of the dispenser anywhere. The proximity detector employs very short pulses of infra-red radiation which are directed downward in a beam aimed toward the area under the dispenser outlet, and in association with a detector of infra-red radiation which is designed to pick up reflected light from a hand or other receiving object placed below the outlet. When the detector picks up a light signal (it is energized continously in order to be in constant readiness), it is converted to a timed pulse which is transmitted to the actuator, opening the valve. A predetermined interval later, another timed pulse is sent to the actuator, closing the valve. The fluid container is a flexible bag which lies in a horizontal postion on a shelf above the detector. The valve means and outlet means are also disposable and are attached to the bag, hanging below it. In order to provide a substantially constant flow rate from the container, a spring-driven pressure plate presses gently on top of the bag and is arranged to press with gradually increasing force as the bag empties, compensating for the naturally slowing flow of the unassisted bag under this condition. This combination of constant flow rate and predetermined open time for the valve yields portions of uniform size.

Figure 1:
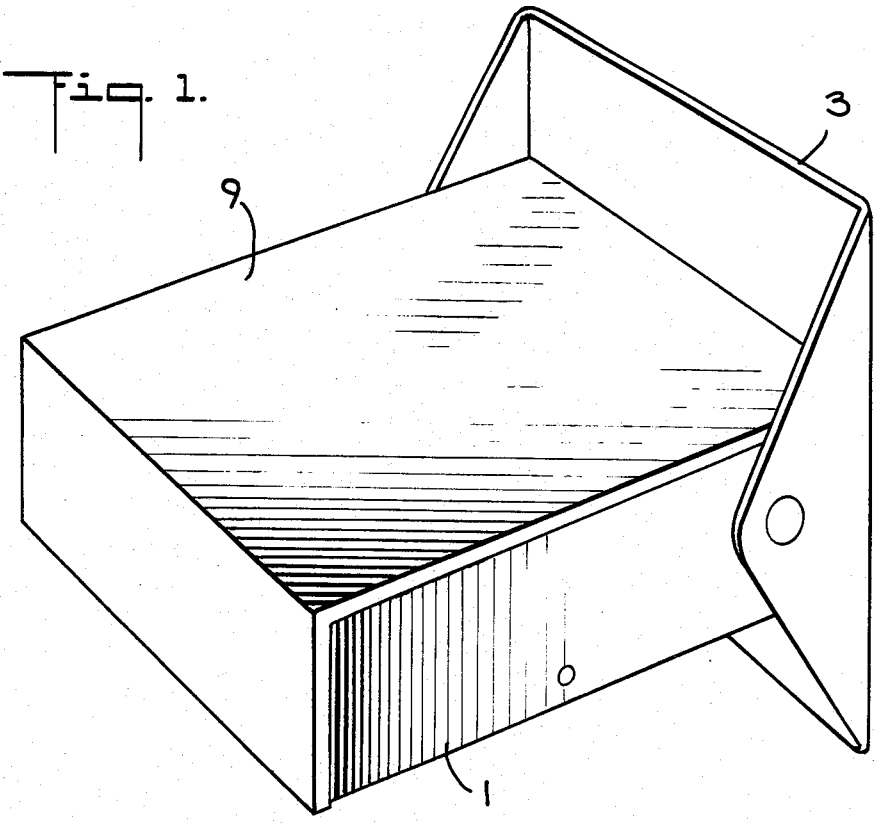
FIG. 1 is an overall view of an embodiment of the dispenser.
Figure 2:
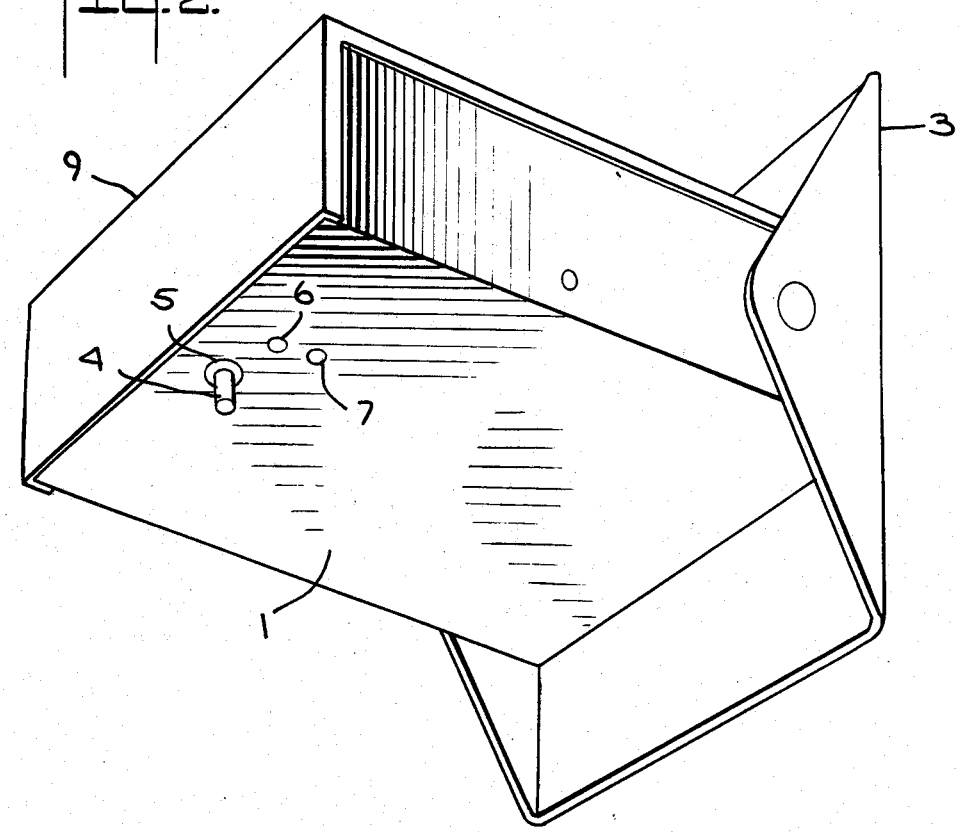
FIG. 2 is a view from beneath the dispenser.

Referring now to the drawings, FIGS. 1 and 2 show two views of the dispenser, and in both of them the front side of the dispenser is on the left, and a wall mount is on the right. The dispenser may be mounted to a wall by means of bracket 3. Fluid is dispensed from outlet 4 which protrudes through dispenser bottom at 1. The proximity detector means uses two infra-red devices: emiter means 6 and detector means 7. Both of these are aimed optically downward in the same direction so that any object near the dispenser and illuminated by the beam from 5 will reflect a portion of this illumination back to detector 7.

Figure 3:
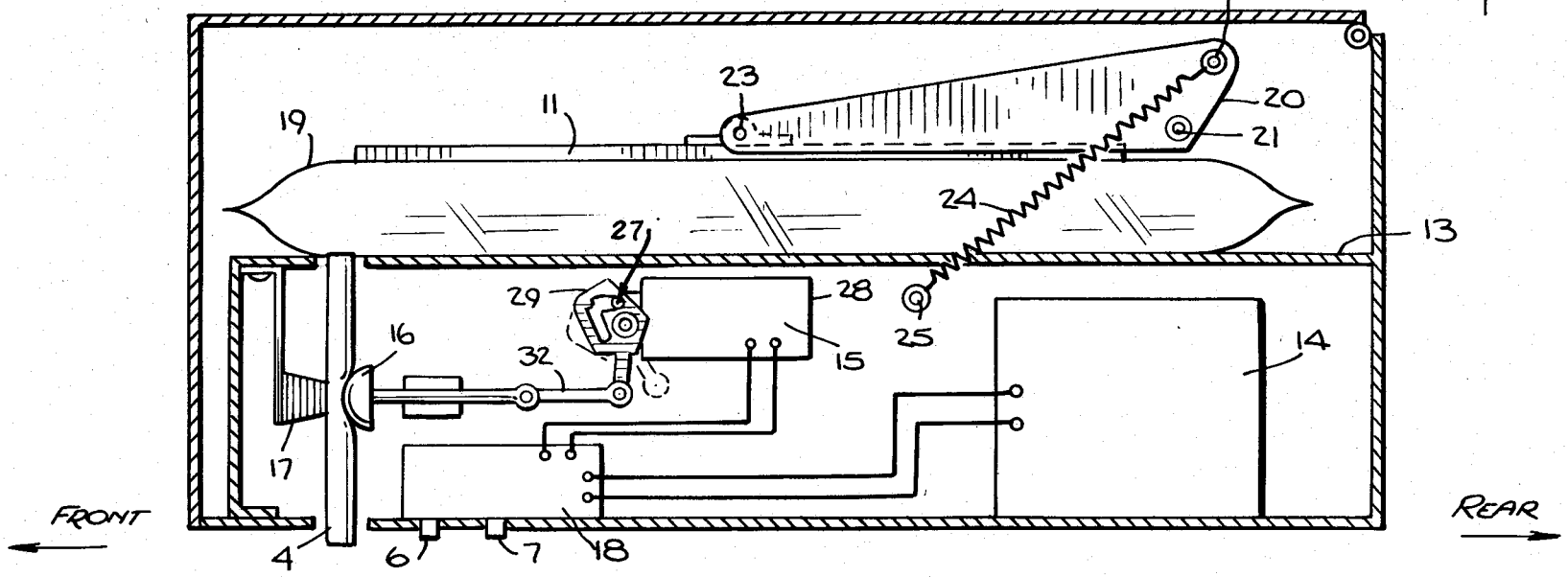
FIG. 3 is a side view of the dispenser showing a sectional view of internal components.

FIG. 3 shows a sectional view of the side of the dispenser. Any flexible material may be employed to create a flexible container. The flexible container is supported by shelf 13. Preferred materials for the container include rubber and heat-sealed plastic sheet material. Flexible outlet tube 4 is sealed to the flexible container and leads to the bottom area of the dispenser as shown. A simple and preferred valve and actuator mechanism consists of a pinching means coupled to a special solenoid actuator. In FIG. 3 the pinch assembly is comprised of fixed pinch jaw 17 and movable pinch jaw 16. One suitable solenoid mechanism 15 is shown in FIG. 3, and is based on the Model S89R bistable impulse relay manufactured by the Potter and Brumfield Division of AMF Corporation. In this mechanism, each pull stroke of the solenoid plunger causes pin 27 to travel toward the heel-end 28 of the solenoid. In the position shown in FIG. 3 the pin thus moves within the upper leg of the vee-slot in cam 29. When the pin reaches the end of the slot (the position shown in FIG. 3) the cam 29 is rotated clockwise, causing the pinch valve to close through the action of link 32 and movable jaw 16. When the solenoid is de-energized, an internal spring (not shown) moves pin 27 back to a position at the apex of the vee slot in cam 29. The next time the solenoid is energized pin 27 traverses the lower leg of the vee slot, at the end of which cam 29 is caused to rotate counter-clockwise, opening the pinch valve. Thus, successive electrical actuations of the solenoid alternately open and close the pinch valve. This is important, because any required quantity of fluid may be dispensed by only two very short impulses—one to open the valve and the other to close it. Using a Potter and Brumfield-type device, an electrical impulse lasting only 0.1 second is needed for each transfer of the cam from one position to the other. Since a typical fluid-dispense event may require as much time as several seconds, the use of an impulse solenoid of this nature saves a great deal of electrical energy from the battery.

The electronic circuit 18 of FIG. 3, powered by battery 14, converts the signal picked up by detector 7 to a short—e.g. 0.1 second—opening pulse. A pre-set interval later, the circuit sends an identical pulse to the solenoid, closing the valve. This pre-set interval is the primary control within the dispenser for the amount of fluid dispensed. It is also an exact control, provided that the flow rate through the valve is constant. If the bag container is simply resting on shelf 13, with only gravity providing pressure on the fluid or its container, the flow rate will decrease from its maximum value when the container is full, to zero when the container is empty. Thus it is necessary to provide an additonal means for gradually increasing pressure on the bag container as the container is gradually emptied during the any successive withdrawals of fluid from the dispenser. In this way the naturally decreasing hydrostatic pressure caused by the height of the fluid level in the bag can be compensated by the aforementioned increase in pressure applied to the bag.

Figure 4:
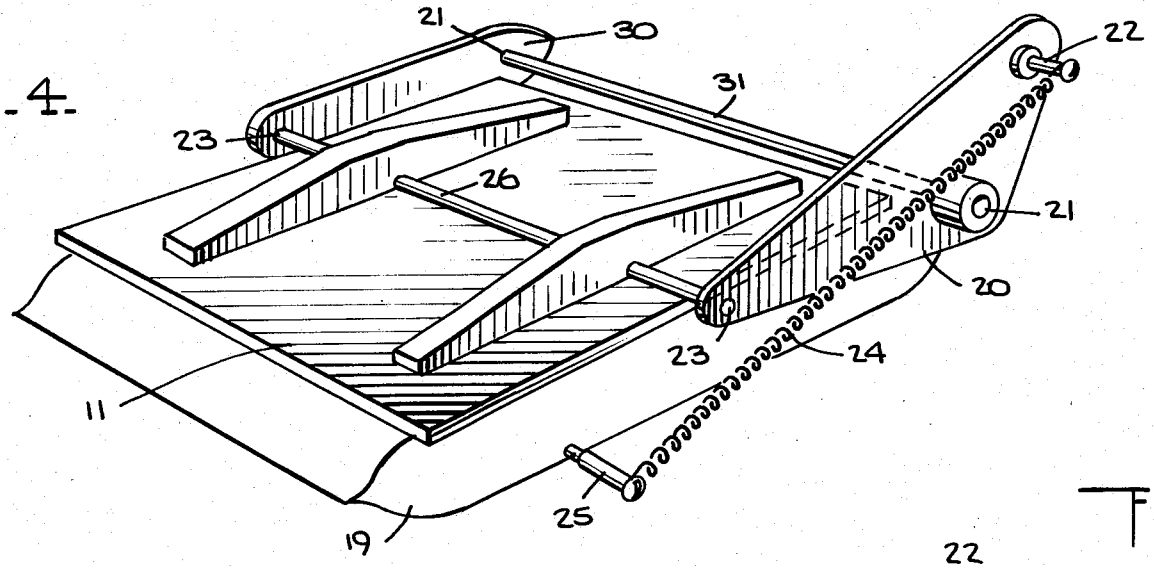
FIG. 4 is a perspective view showing the pressure plate lowered in its position on the container bag.

FIGS. 4 and 5 show the general arrangement of the dispenser parts. In particular, FIG. 4 shows that the flexible bag 19 lies under a pressure plate 11 which is attached in a pivoting manner to axle 26. This axle, in turn, is solidly attached to a straight lever 30 and a triangular lever 20. These two levers are attached together by a shaft 31 which is free to rotate in holes or bearings which are an integral part of the dispenser framework (not shown). Extension spring 24 is attached to the dispenser framework at 25 and to the triangular lever at 22. In the position shown in FIG. 4 the spring is attempting to cause counterclockwise rotation of the triangular lever, and hence a downward motion on the pressure plate. Referring still to FIG. 4, if one were to raise the pressure plate until the centerline of spring 24 passed directly over the centerline of shaft 21, then the spring would exert no torque on the triangular lever and there would be no force exerted downward on the pressure plate. Thus it can be seen that, as the pressure plate moves downward from a "dead-center" position, the centerline of the spring moves away from its position directly over the centerline of shaft 21 and this causes a progressively increasing torque to be applied to the triangular lever. The foregoing statement is strictly true only when the spring is long enough to provide a decrease in force along its own axis, as the triangular lever moves counterclockwise, which is less than the increasing torque effect caused by the increase in distance of the spring centerline from the centerline of shaft 21. In practice this is a very simple conditon to meet, since the total travel of the pressure plate is small and the effect of shortening the spring as the fluid leaves the container is very much less than the effect of increasing the moment-arm in the mechanism, or the distance from the spring centerline to the centerline of shaft 21. As an essential feature of the present invention, it is only necessary to provide a means for increasing pressure-plate force which is subtantially equal to the decreasing effect of progressively-decreasing hydrostatic pressure occuring as the container is emptied.

FIG. 3 reveals that the dispensed fluid touches only the disposable flexible container 19 and the flexible outlet tube 4. Thus there is no clean-up needed when an empty container is replaced by a full one, the entire fluid flow path being replaced and renewed when the container, assembly is replaced. In order to permit easy replacement of the container fixed pinch jaw 17 may be adapted to be swung out of the way during container and outlet tube replacement. It is clear that alternative valve mechanisms may be used, as long as they are disposable and adapted to operate in association with solenoid 15. A poppet or movable-flap type of valve, for example, may be used. Also, a rotary valve may be employed, deriving its actuation from the angular motion of the cam 29. As an alternative valve mechanism, the resilient tube 4 may be bent to provice a kink seal. The minimum angle to provide a kink seal is defined for each resilient material and can be accomplished by any mechanism that bends the tube to the required angle.

Use of the pressure plate 11, also gives rise to a simple indicator for the quantity of fluid in the container. This is done, for example, by mounting a graduated dial (not shown) on shaft 31. The angular position of the dial is a direct indication of the amount of fluid in the bag. Alternatively, a switch or other electrical transducer may be mounted in cooperation with the levers 20 and 30 so that upon approaching a nearly empty condition of the container the position of the lever is sensed by the switch, lighting a lamp or the like.

Figure 6:
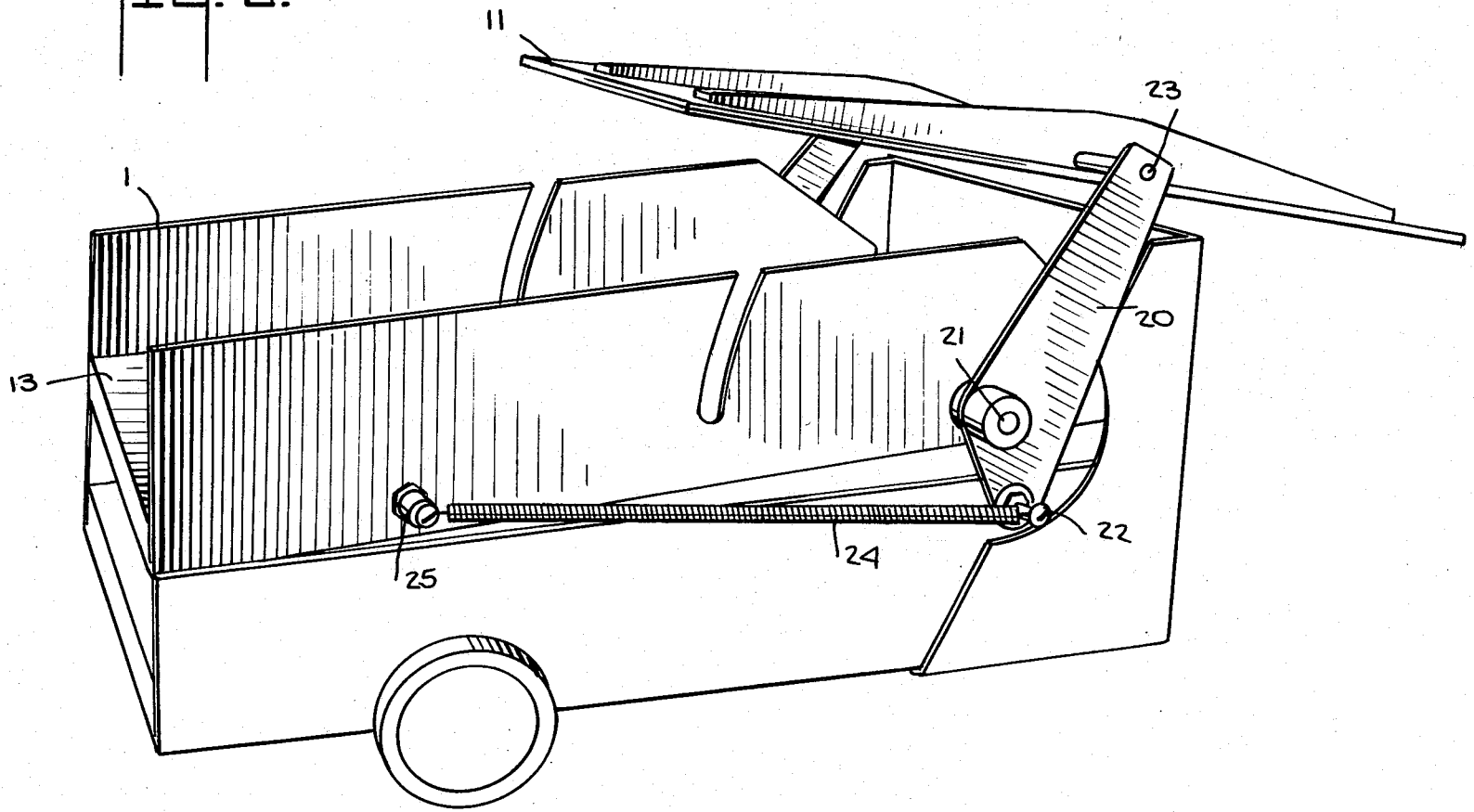
FIG. 6 is a block diagram of the electronic circuits of the dispenser.
Figure 6:
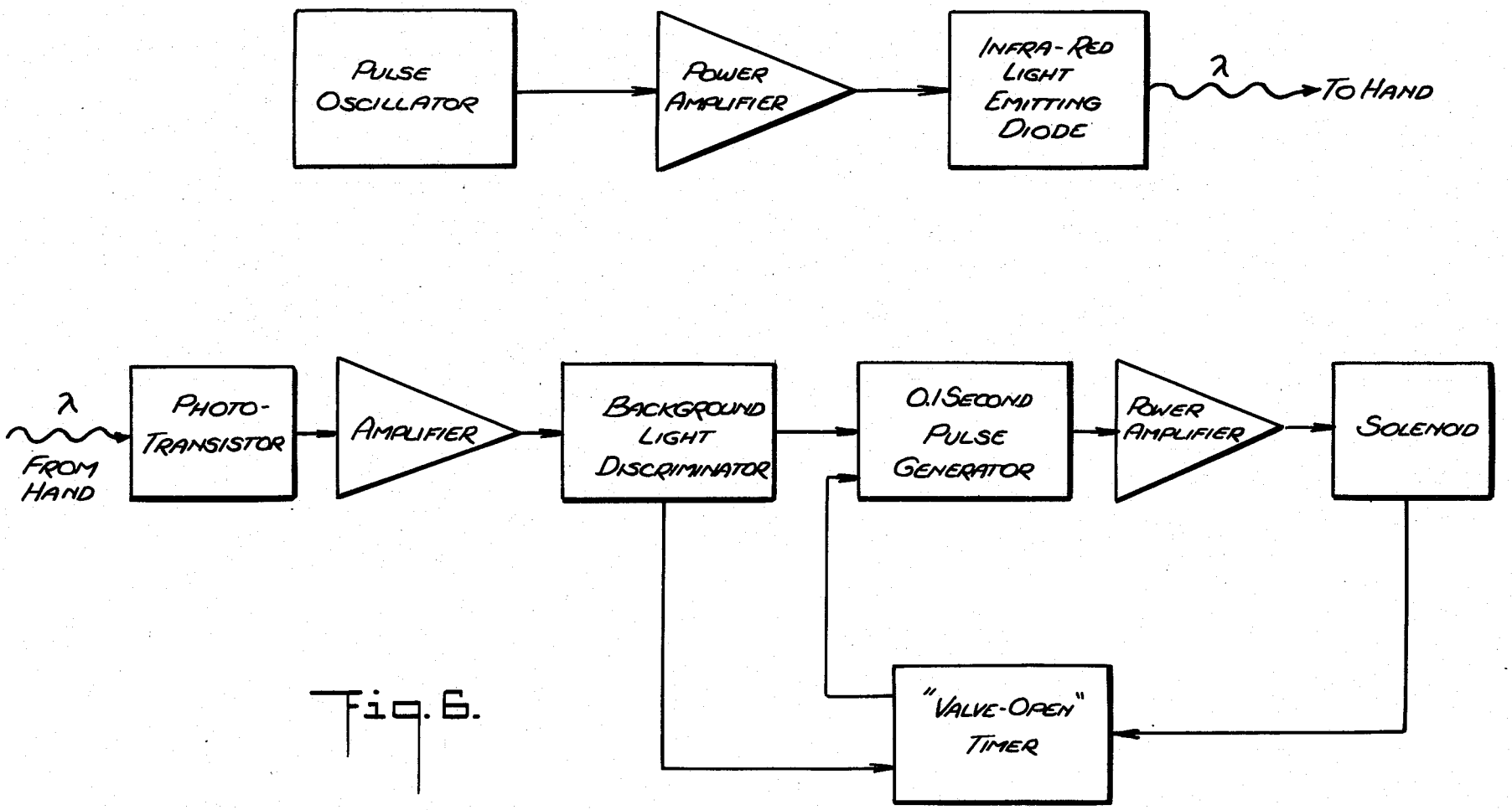

A major objective of the present invention is to reduce the electrical energy required for continuous dispenser use. Two major components for electrical consumption are present; (1) the valve solenoid and (2) the light emitter portion of the proximity detector. Valve solenoid power comsumption has been lowered appreciably by the use of a bistable device, as explained above. To reduce energy consumption of the other component, this invention employs a far lower pulse frequency and pulse duty cycle than are used in other proximity detectors used for general industrial purposes. Preferred values are nears 5–10 pulses per second and a duty cycle of near 0.007. Also, the lowest effective emitter current is used. FIG. 6 shows the block diagram of the electronic circuits of the dispenser. Reflected radiaton is received by the phototransistor, whose signal is amplified and then separated from ambient light in a level clipper. The resulting signal is fed to the 0.1 second pulse generator which causes the solenoid to stroke and open the valve. An auxiliary switch on the solenoid causes, through feedback path A, a variable timer to generate a "valve-open" interval, at the end of which a signal is sent to the same 0.1 second pulse generator, stroking the solenoid again and closing the valve. An additional circuit path B stops the interval timer if the hand is removed prematurely from below the dispenser and immediately causes a solenoid pulse which closes the valve before the normal open interval has transpired.

An additional means for lowering consumption of electrical energy may be employed as an addition to the preferred embodiment of this invention. This is an additional circuit, not shown in the Figures, which senses the presence or absence of general room illumination in the location of the dispenser. In operation, a simple power-transistor gate, actuated by a cadmium-sulfide photoresistor located on or near the exterior of the dispenser, shuts down the dispenser electronics until such time as the room lights are turned on again. In, for example, an industrial situation wherein only a single-shift schedule is being worked, the battery life in the dispenser would be approximately tripled over that obtained without this feature.

What is claimed is:

1. A fluid dispenser comprising:

(a) a flexible container for fluid integrally connected to a valve means and an outlet means;

(b) a means for imparting a squeezing force to said flexible container; and (c) a proximity detector means connected to a means for opening and closing said valve means; wherein said means for imparting a squeezing force is a pressure plate which is connected to a spring-driven lever which comprises:

(i) an extension spring whose axis is near the central pivot point of a first-class lever when said flexible container is full, said spring axis moving away from said pivot point of said lever as said flexible container is emptied;

(ii) said first-class level having extremities that comprise the attachment point of said extension spring to the lever and the attachment point of an axle attached to the pressure plate, respectfully; and (iii) said spring having a sufficient length so that the torque increase caused by the increasing distance of the spring center line from the central pivot point as said container empties is more than the torque decrease caused by the lessening extension of the spring caused by movement of the lever as said flexible container empties.

2. The fluid dispenser of claim 1 wherein said flexible container is formed of at least two thermoplastic sheets which are fastened together by heat sealing or ultrasonic welding.

3. The fluid dispenser of claim 1 wherein said valve means and outlet means comprises a flexible tube and a pinch means for pinching the flexible tube to stop the flow of fluid from the container to enable fluid flow.

4. The fluid dispenser of claim 1 wherein said means for opening said valve means comprises an electromagnetic actuator.

5. The fluid dispenser of claim 4 wherein said actuator is powered by batteries.

6. The fluid dispenser of claim 4 wherein said actuator is controlled by said proximity detector means and an electric circuit connected therebetween whereby, the actuator is reponsive to the presense of a object placed near the proximity detector means.

7. The fluid dispenser of claim 4 wherein said electromagnetic actuator is a solenoid.

8. The fluid dispenser of claim 1 wherein said flexible container is a plastic or rubber bag which has a thickness when filled with fluid, no greater than 20% of its length and its width being less than its length.

9. The fluid dispenser of claim 8 wherein said container, valve means and outlet means are disposable.

10. The fluid dispenser of claim 8 wherein said flexible container lies flat upon a substantially horizontal shelf.

* * * * *